US007787806B2

(12) United States Patent
Sato

(10) Patent No.: US 7,787,806 B2
(45) Date of Patent: Aug. 31, 2010

(54) IMAGE FORMING DEVICE, DEVELOPING DEVICE AND TONER CARTRIDGE

(75) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 984 days.

(21) Appl. No.: 11/523,631

(22) Filed: Sep. 20, 2006

(65) Prior Publication Data

US 2007/0071503 A1 Mar. 29, 2007

(30) Foreign Application Priority Data

Sep. 21, 2005 (JP) ..... 2005-274099

(51) Int. Cl.
*G03G 15/08* (2006.01)

(52) U.S. Cl. ..... 399/258; 399/260; 399/262

(58) Field of Classification Search ..... 399/258, 399/254–256, 260, 262, 263
See application file for complete search history.

(56) References Cited

U.S. PATENT DOCUMENTS

| | | | | |
|---|---|---|---|---|
| 5,103,264 | A | 4/1992 | Bhgat | |
| 5,179,414 | A * | 1/1993 | Bhagat | 399/258 |
| 5,630,198 | A * | 5/1997 | Makino | 399/120 |
| 5,867,756 | A | 2/1999 | Suzuki et al. | |
| 6,072,969 | A | 6/2000 | Yokomori et al. | |
| 2004/0213603 | A1 | 10/2004 | Shigeta et al. | |

FOREIGN PATENT DOCUMENTS

| | | |
|---|---|---|
| JP | 04-115268 A | 4/1992 |
| JP | 9114214 | 5/1997 |
| JP | 9297444 | 11/1997 |
| JP | 9319201 | 12/1997 |
| JP | 9319202 | 12/1997 |
| JP | 2000275944 | 10/2000 |
| JP | 2002-49209 A | 2/2002 |

OTHER PUBLICATIONS

Extended European Search Report dated Feb. 13, 2007 in European Application No. 06019609.4.

* cited by examiner

*Primary Examiner*—David M Gray
*Assistant Examiner*—Rodney Bonnette
(74) *Attorney, Agent, or Firm*—Banner & Witcoff, Ltd

(57) ABSTRACT

An image forming device has: a developing cartridge for developing an electrostatic latent image on an image carrying member and a toner cartridge. The developing cartridge contains a developing roller and a single auger. The toner cartridge is detachably attached to the developing cartridge and containing toner. The toner cartridge has an agitation mechanism that agitates the toner, a conveyance mechanism that conveys the toner to the agitation mechanism, and two ports, the two ports being aligned in the axial direction and communicated with the developing cartridge, respectively. The toner cartridge and the developing cartridge are arrayed side by side in a horizontal direction. The toner cartridge has a shape having a vertical cross section in which a horizontal length is greater than a vertical length.

1 Claim, 8 Drawing Sheets

IMAGE FORMING DEVICE, DEVELOPING DEVICE AND TONER CARTRIDGE

CROSS REFERENCE TO RELATED APPLICATIONS

This application claims priority from Japanese Patent Application No. JP2005-274099 filed on Sep. 21, 2005. The entire content of this priority application is incorporated herein by reference.

TECHNICAL FIELD

The disclosure relates to an image forming device that develops an electrostatic latent image formed on an image carrier with toner and transfers the developed image on a recorded medium by electrophotographic printing. In particular, this disclosure relates to a developing device and a toner cartridge used in the image forming device.

BACKGROUND

A conventional image forming device includes an image carrier on which an electrostatic latent image is formed, a toner cartridge which stores toner to be used for development of the electrostatic latent image, a developing roller which charges the toner and allows the charged toner to be adhered to a surface of the image carrier to develop the electrostatic latent image, a developing cartridge detachably attached to the toner cartridge and including the developing roller, and a transfer unit which transfers the toner adhered on the image carrier to a recorded medium.

In this kind of image forming device, when the electrostatic latent image is formed on the image carrier, the developing roller charges the toner, allows the charged toner to be adhered to the image carrier and develops the electrostatic latent image. Subsequently, when the transfer unit transfers the toner adhered on the image carrier to the recorded medium, an image corresponding to the electrostatic latent image is formed on the recorded medium. Since the toner cartridge is detachably attached to the developing cartridge, the toner cartridge can be exchanged when the toner is exhausted.

Japanese Patent Application Publication No. Hei09-319201 discloses an image forming device having an agitator provided in the toner cartridge to feed the toner stored in the toner cartridge to the developing cartridge, while agitating the toner; and an auger provided in the developing cartridge to conveying the toner within the developing cartridge. In this case, by driving the agitator and the auger simultaneously, the toner is circulated between the developing cartridge and the toner cartridge. Therefore, the toner is prevented from concentrating at one point and/or becoming hardened, resulting in that liquidity of the toner is ensured to improve the image quality.

Japanese Patent Application Publication No. Hei9-319202 discloses an image forming device having a toner cartridge with a feed port and a return port and an agitator, and an auger. The feed port is formed at one end of the toner cartridge in an axial direction of a developing roller to face the developing cartridge and feed the toner into the developing cartridge. The return port is formed at the other end of the toner cartridge in the axial direction to face the developing cartridge and return the toner into the toner cartridge. The agitator is provided inside the toner cartridge to agitate the toner. The auger conveys the toner along the axial direction in the developing cartridge, while mixing the toner. Therefore, some of the toner which has not been adhered to the developing roller is returned to the toner cartridge. In this way, the toner is circulated between the developing cartridge and the toner cartridge by the auger and the agitator.

The image forming devices such as a laser printer and a facsimile machine are often used on a desk in an office. Thus, there is a demand for manufacturing a compact-sized image forming device.

An object of the invention is provide a toner cartridge and a developing device including the same that circulates the toner between the toner cartridge and the developing cartridge in a down-sized image forming device.

SUMMARY

The invention provides an image forming device having: an image carrying member, a developing cartridge, a toner cartridge, and a transfer unit. The image carrying member has a surface on which an electrostatic latent image is provided. The developing cartridge contains a developing roller and a single auger. The developing roller has a rotation axis extending in an axial direction and a cylindrical surface on which toner for developing the electrostatic latent image is carried. The auger conveys the toner along the axial direction. The toner cartridge is detachably attached to the developing cartridge and containing the toner. The toner cartridge has an agitation mechanism that agitates the toner, a conveyance mechanism that conveys the toner to the agitation mechanism, and two ports, the two ports being aligned in the axial direction and communicated with the developing cartridge, respectively. The transfer unit transfers the developed electrostatic latent image on the image carrying member to a recording medium. The toner cartridge and the developing cartridge are arrayed side by side in a horizontal direction. The toner cartridge has a cross section perpendicular to the axial direction. The cross section has a vertical length and a horizontal length which is greater than the vertical length during operation.

The invention provides a developing device having: a developing cartridge and a toner cartridge. The developing cartridge contains a developing roller and a single auger. The developing roller has a rotation axis extending in an axial direction and a cylindrical surface on which toner for developing an electrostatic latent image is carried. The auger conveys the toner along the axial direction. The developing cartridge has an inlet port and an outlet port. The toner cartridge is detachably attached to the developing cartridge and containing the toner. The toner cartridge includes an agitation mechanism that agitates the toner, a conveyance mechanism that conveys the toner to the agitation mechanism, a feed port, and a return port, the feed and return ports respectively being communicable with the inlet and outlet ports. The toner cartridge has a cross section perpendicular to the axial direction. The cross section has a first length in a first direction directed to the developing cartridge, and a second length in a second direction perpendicular to the first direction and perpendicular to the axial direction. The first length is greater than the second length.

The invention provides a toner cartridge containing toner to develop an electrostatic latent image. The toner cartridge is attachable to a developing cartridge. The toner cartridge has: a substantially rectangular mounting surface, an agitation mechanism, a conveyance mechanism, an outlet port, and an inlet port. The rectangular mounting surface is detachably attached to the developing cartridge, facing the developing cartridge. The mounting surface has two ends in a longitudinal direction. The agitation mechanism agitates the toner. The conveyance mechanism conveys the toner to the agitation mechanism. The feed port is provided in one end of the mounting surface. The feed port is communicable with the developing cartridge. The return port is provided in the other end of the mounting surface. The return port is communicable with the developing cartridge. The toner cartridge has a cross section perpendicular to the longitudinal direction. The cross section has a first length in a direction directed to the mounting surface, and a second length in a direction perpendicular to the first direction and perpendicular to the longitudinal direction. The first length is greater than the second length.

BRIEF DESCRIPTION OF THE DRAWINGS

Illustrative aspects in accordance with the invention will be described in detail with reference to the following figures wherein.

DETAILED DESCRIPTION

Figure 1:
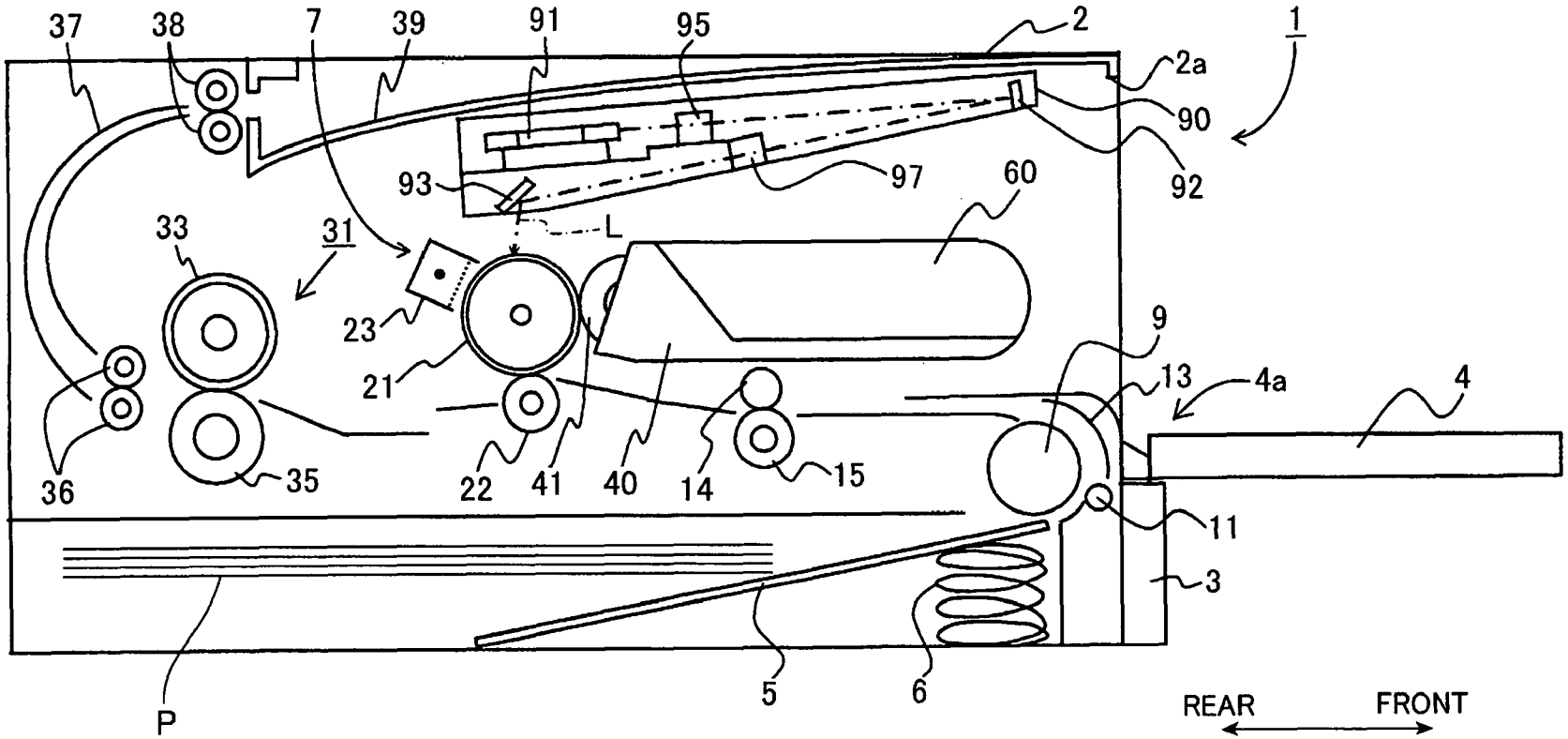
FIG. 1 is a vertical cross-sectional view showing a laser printer according to some aspects.

Next, an image forming device according to some aspects of the invention will be described while referring to the accompanying drawings, wherein like parts and components are designated by the same reference numerals to avoid duplicating description. The expressions "front", "rear", "up", "down", "right", and "left" are used throughout the description to define the various parts anc components when the image forming device is disposed in an orientation in which it is intended to be used.

Referring to FIG. 1, a laser printer 1 according to the above aspects provides an image by using positively-charged non-magnetic one-component toner such as styrene acrylic polymer toner. The laser printer 1 includes a sheet feeding portion 10 for feeding a sheet P, an image-forming portion 7 for forming images on the sheet P supplied by the sheet feeding portion 10 in a main casing 2, and a fixing portion 30 for fixing the toner images to the sheet P. In the following description, the left and right sides in FIG. 1 will be referred to as the front and the rear, respectively.

Referring to FIG. 1, the main casing 2 has a front cover 4 provided in a front surface thereof. The front cover 4 is pivotable about a hinge 4*a* to cover an opening 2*a* formed in the front surface. The opening 2*a* is usually closed by the front cover 4. In FIG. 1, the front cover 4 is open.

The sheet feeding portion 10 includes a sheet feeding cassette 3 for containing a sheet in a stacked manner. The sheet feeding portion 10 is detachabley accommodated in a lower portion of the main casing 2, so that the sheet feeding cassette 3 can be pulled out of the front surface. A supporting plate 5 is provided in the sheet feeding cassette 3 to be urged upward by a spring 6. A sheet feeding roller 9 is disposed on the front side above the supporting plate 5 for separating the sheets P stacked thereon by one and feeding the sheet in a direction to an image forming portion 7.

A conveying roller 11, a guide 13, and a pair of register rollers 14, 15 are arranged in this order in a sheet feeding path from the sheet feeding roller 9 to the image forming portion 7. The conveying roller 11 conveys the sheet in cooperation with the sheet feeding roller 9. The guide 13 turns back the sheet conveyed by the conveying roller 11 by 180 degrees along the circumference of the sheet feeding roller 9. The pair of register rollers 14, 15 register a front end of the sheet, while suspending the feed of the sheet P in an appropriate manner.

The image forming portion 7 includes a scanner unit 90, an exposing unit 20 having a photosensitive drum 21, and a developing cartridge 40. The scanner unit 90 is located between the developing cartridge 40 and the upper surface of the main casing 2. The scanner unit 90 has a laser light generator (not shown) for emitting a laser beam L, a polygon mirror 91, and mirrors 92, 93 arranged in turn on an optical path of the laser beam L from the laser generator to the photosensitive drum 21. The polygon mirror 91 deflects and scans the laser beam L. The mirrors 92, 93 reflect the laser beam L deflected by the polygon mirror 91 in turn to the developing cartridge 40. The scanner unit 90 further includes an fθ lens 95 and a cylindrical lens 97 on the optical path. The fθ lens 95 is located between the polygon mirror 91 and the mirror 92. The cylindrical lens 97 is located between the mirror 92 and the mirror 93. Accordingly, the scanning unit 90 forms an electrostatic latent image on the photosensitive drum 21 by the laser beam L.

The exposing unit 20 has the photosensitive drum 21, a transfer roller 22, and a scorotron charger 23. The photosensitive drum 21 has a photosensitive layer on a surface thereof, and is rotatable about a rotation shaft. The transfer roller 22 is provided to contact the photosensitive layer of the photosensitive drum 21. The scorotron charger 23 uniformly charges the photosensitive layer of the photosensitive drum 21. An electrostatic latent image is formed on the photosensitive layer charged by the scorotron charger 23 by the laser beam L emitted from the scanner unit 90.

The developing cartridge includes a developing roller 41 to feed toner from a toner cartridge 60 to the surface of the photosensitive drum 21 for developing the electrostatic latent image with the toner. The toner which has been adhered to the photosensitive drum 21 is transferred on the sheet when the sheet passes between the photosensitive drum 21 and the transfer roller 22. Thus, the developed image is carried on the sheet P. The sheet is then fed to the fixing unit 30.

In the fixing unit 31, the sheet is placed between a heating roller 33 and a pressing roller 35 so that the toner carried on the sheet P is thermally fixed to the sheet. The sheet is then conveyed by a pair of conveying rollers 36, 36.

The sheet P is then guided to an upper portion of the main casing 2 by a guide 37, and discharged on a sheet discharge tray 39 provided on the upper surface of the main casing 2 by a pair of sheet discharging rollers 38, 38.

As described above, an electrostatic latent image is formed on the photosensitive layer of the photosensitive drum 21 by scanning the laser beam L, while rotating the polygon mirror 91 and the photosensitive drum 21. The electrostatic latent image is then developed by the toner and transferred to the sheet P, so that the image is formed on the sheet.

The next description will be made for describing the details of the developing cartridge 40 and the toner cartridge 60 referring to FIGS. 2A through 7. Referring to FIG. 1, the developing cartridge 40 and the toner cartridge 60 are removable from the main casing 2 through the opening 2*a* in the front surface thereof.

Figure 2A:
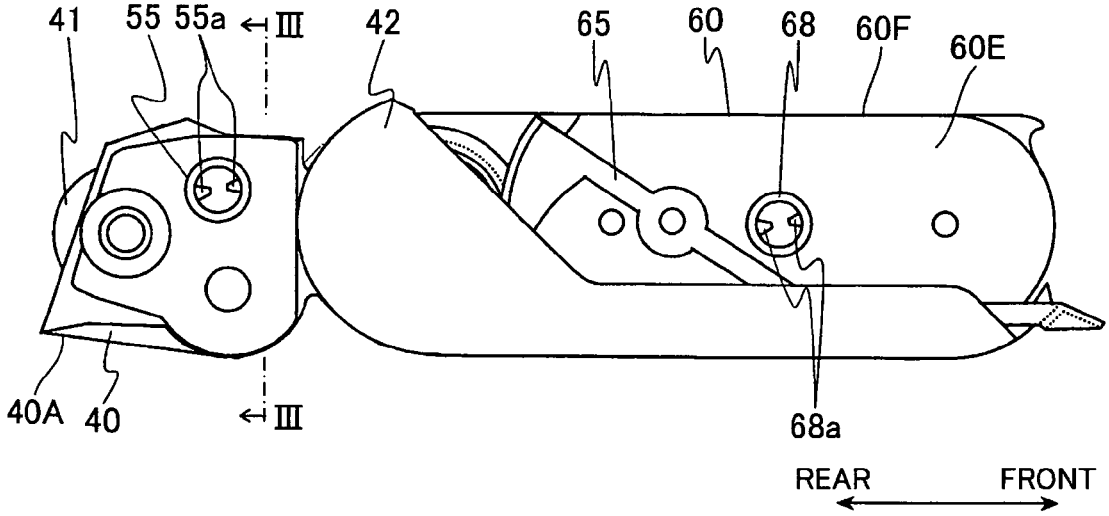
FIG. 2A is a side view showing a developing cartridge and a toner cartridge mounted to in the laser printer shown in FIG. 1.
Figure 2B:
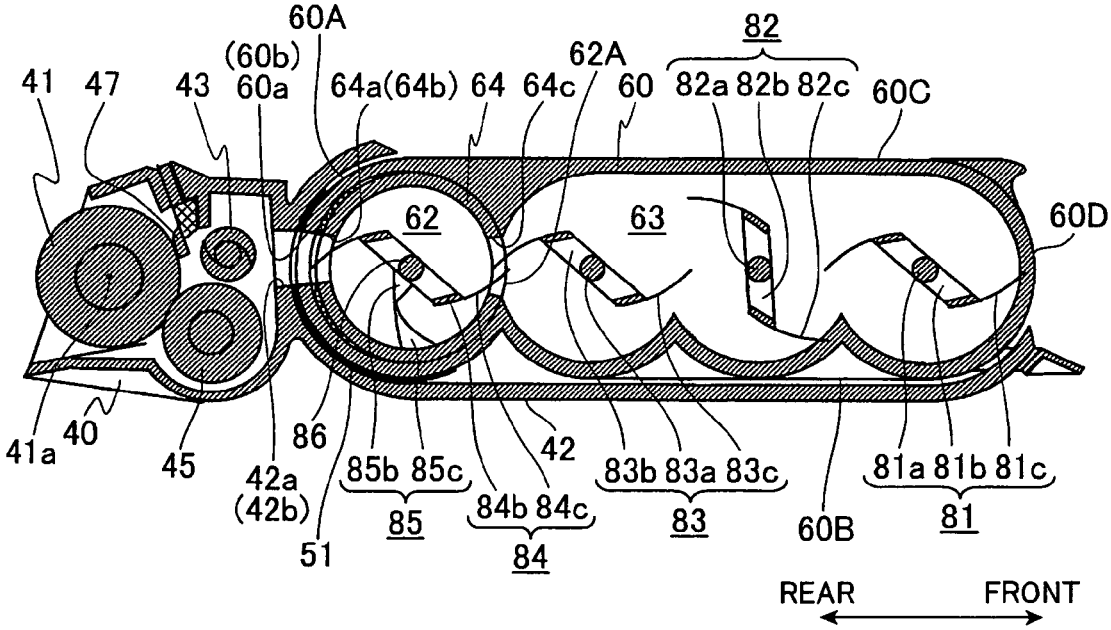
FIG. 2B is a vertical sectional view showing the developing cartridge and the toner cartridge shown in FIG. 2B.

Referring to FIG. 2B, the developing cartridge 40 has a developing portion 40A for accommodating the developing roller 41 and a supporting portion 42 for receiving and supporting the toner cartridge 60. The supporting portion 42 is made integrally with the developing portion 40A, and adjacent to the developing portion 40A in a horizontal direction during an operation of the laser printer 1.

The developing portion 40A supports the developing roller 41 to be rotated in contact with the photosensitive drum 21. The developing roller 41 has a rotation axis 41a extending perpendicularly to the sheet feeding path and a cylindrical surface 41*b* for carrying toner thereon. The developing portion 40A further accommodates a single auger 43, a supply roller 45, and a developing blade 47. The auger 43 has a rotation axis 43*a* and a spiral teeth 43*b* around the rotation axis 43*a*. The auger 43 is provided parallel with the developing roller 41. When the auger 43 rotates about the rotation axis 43*a*, the auger 43 transfers the toner fed from the toner cartridge 60 along an axial direction in the developing cartridge 40. The supply roller 45 feeds the toner transferred by the auger 43 to the developing roller 41. The developing blade 47 forms a thin layer of toner on the surface of the developing roller 41 and frictionally charges the toner.

Figure 3A:
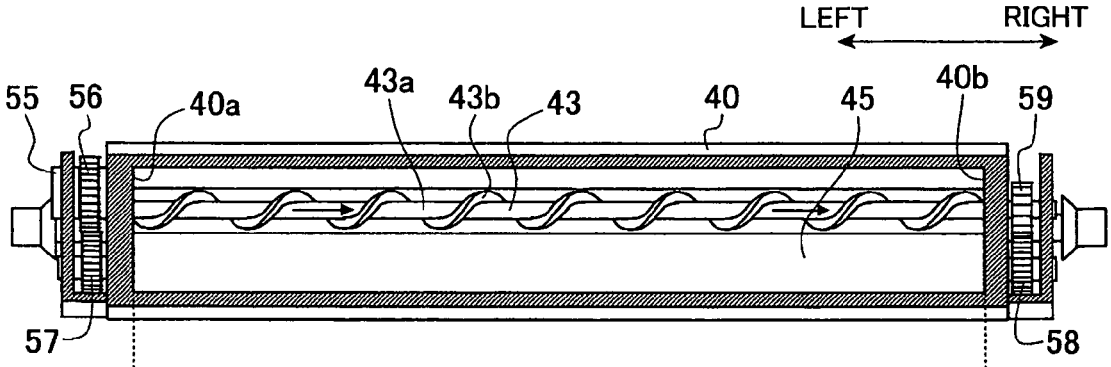
FIG. 3A is a vertical cross sectional view showing the developing cartridge, taken along III-III lines of FIG. 2A.
Figure 3B:
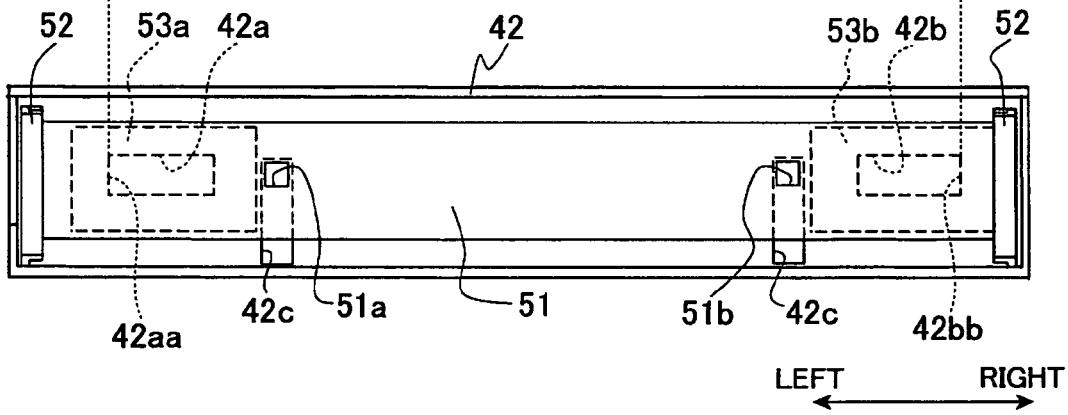
FIG. 3B is a font view showing the developing cartridge.

Referring to FIG. 2B, the supporting portion 42 has an opening 42*a* in a connecting portion with the developing portion 40A to communicate the developing portion 40A with the toner cartridge 60. Referring to FIG. 3B, the opening 42*a* is formed in a left end of the supporting portion 42 in an axial direction of the developing roller 41. The supporting portion 42 further has an opening 42*b* formed on a right end in the connecting portion in an axial direction of the developing roller 41. A shutter 51 is provided in the supporting portion 42 to move along guides 52 and close the openings 42*a*, 42*b*.

The toner cartridge 60 has a substantially box shape having a mounting surface 60A facing the opening 42*a* and 42*b* and a lower surface 60B supported by the supporting portion 42. The toner cartridge 60 further has an upper surface 60C opposite to the lower surface 60B, a front surface opposite 60D to the mounting surface 60A, and a pair of side surfaces 60E and 60F. The longitudinal length between the mounting surface 60A and the front surface 60D is longer than the vertical length between the upper surface 60D and the lower surface 60B. Therefore, the toner cartridge 60 has a short height, when the toner cartridge 60 is mounted in the laser printer 1.

The toner cartridge 60 has a feed port 60*a* at a left end and a return port 60*b* at a right end of the mounting surface 60A. The feed port 60*a* is provided to face the opening 42*a* of the developing cartridge 40 for passing the toner from the toner cartridge 60 to the developing cartridge 40. The return port 60*b* is provided to face the opening 42*b* for passing the toner from the developing cartridge 40 to the toner cartridge 60.

When the openings 42*a*, 42*b* communicate with the feed port 60*a* and the return port 60*b*, respectively, the toner is fed from the toner cartridge 60 to the developing cartridge 40 through the feed port 60*a* and the opening 42*a*. As shown in FIG. 3A, when the auger 43 is rotated, the toner entered from the opening 42*a* is conveyed to the opening 42*b* in the developing cartridge 40. The toner is then ejected through the opening 42*b* and the return port 60*b*, and returned to the toner cartridge 60. In this embodiment, as shown in FIGS. 3A and 3B, an outer edge 42*aa* of the opening 42*a* is flush with a left inner side wall 40*a* of the developing cartridge 40. An outer edge 42*bb* of the opening 42*b* is flush with a right inner side wall 40*b* of the developing cartridge 40. Accordingly, all of the toner entered through the opening 42*a* can be readily transferred toward the other opening 42*b* without remaining at either one of left and right ends of the developing cartridge 40.

With the above structure, the toner cartridge 60 is mounted in and supported by the supporting portion 42 to be positioned adjacently to the developing portion 40A. As shown in FIGS. 2B, 4A, 4B, 6, and 7, the toner cartridge 60 received by the supporting portion 42 in the laser printer 1 has a flat shape having a vertical cross-section in which a vertical length is shorter that a horizontal length.

When the shutter 51 moves downward to open the openings 42*a*, 42*b*, the openings 42*a*, 42*b* communicate with the feed port 60*a* and the return port 60*b*, respectively, so that the toner cartridge 60 communicates with the developing portion 40A.

The opening 42*a*, 42*b*, the feed port 60*a*, and the return port 60*b* have the same rectangular shape. Sponge members 53*a*, 53*b*, 61*a*, and 61*b* having the same shape are attached around the opening 42*a*, 42*b*, the feed port 60*a*, and the return port 60*b*, respectively. When the openings 42*a*, 42*b* are communicated with the feed port 60*a* and the return port 60*b*, respectively, the sponge members 53*a*, 53*b* contact the sponge member 61*a*, 61*b* closely, respectively, thereby preventing the toner from leaking between the sponge members 53*a* and 61*a*; and the sponge members 53*b* and 61*b*.

Referring to FIG. 2, the toner cartridge 60 is divided into a circulating chamber 62 and an accumulating chamber 63. The circulating chamber 62 has the feed port 60*a* and the return port 60*b*. The circulating chamber 62 is communicated with the accumulating chamber 63 through a narrower communicating opening 62A on the opposite side of the mounting surface 60A.

The circulating chamber 62 has a cylindrical inner surface 62*a* extending in the axial direction of the rotation axis 41*a* of the developing roller 41. The feed port 60*a* and the return port 60*b* are formed in an outer wall of the circulating chamber 62. The circulating chamber 62 accommodates a cylinder 64 having two sealed ends. The cylinder 64 is rotatably fitted inside circulating chamber 62. Openings 64*a*, 64*b* having the same shape as the feed port 60*a* and the return port 60*b* are formed in the cylindrical surface 62*a* of the cylinder 64. When the cylinder 64 is rotated to a communicating position in the circulating chamber 62, the openings 64*a*, 64*b* are aligned and communicated with the feed port 60*a* and the return port 60*b*, respectively.

An opening 64*c* is formed on the opposite portion of the cylindrical inner surface 62*a* to the openings 64*a* and 64*b* with respect to a central axis of the cylinder 64. The opening 64*c* has a rectangular shape with a longitudinal length extending along the axial direction of the cylinder 64. When the cylinder 64 is rotated to the communicating position, the opening 64*c* is located so as to communicate the circulating chamber 62 with the accumulating chamber 63.

Figure 4A:
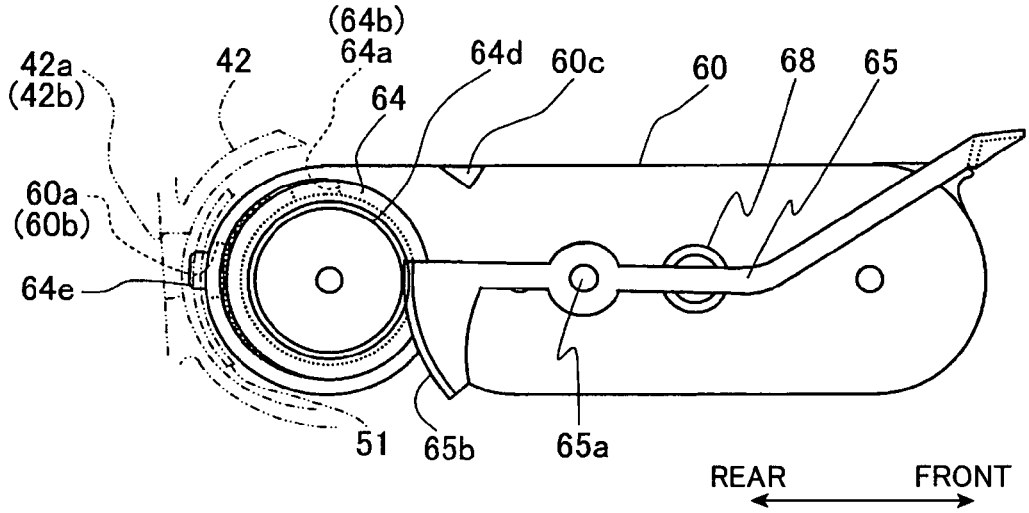
FIGS. 4A and 4B are left side views showing the toner cartridge.
Figure 4B:
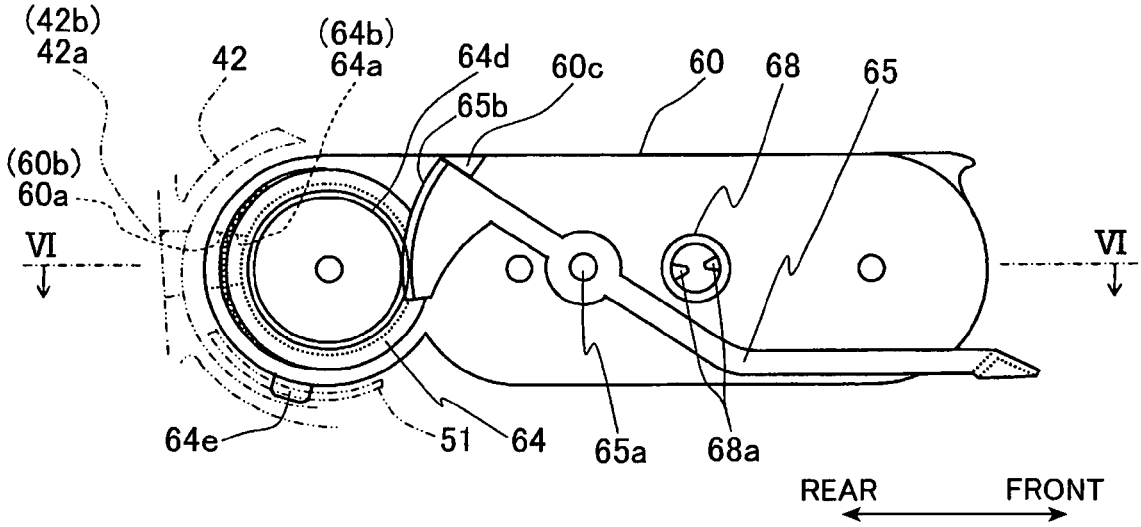
Figure 5:
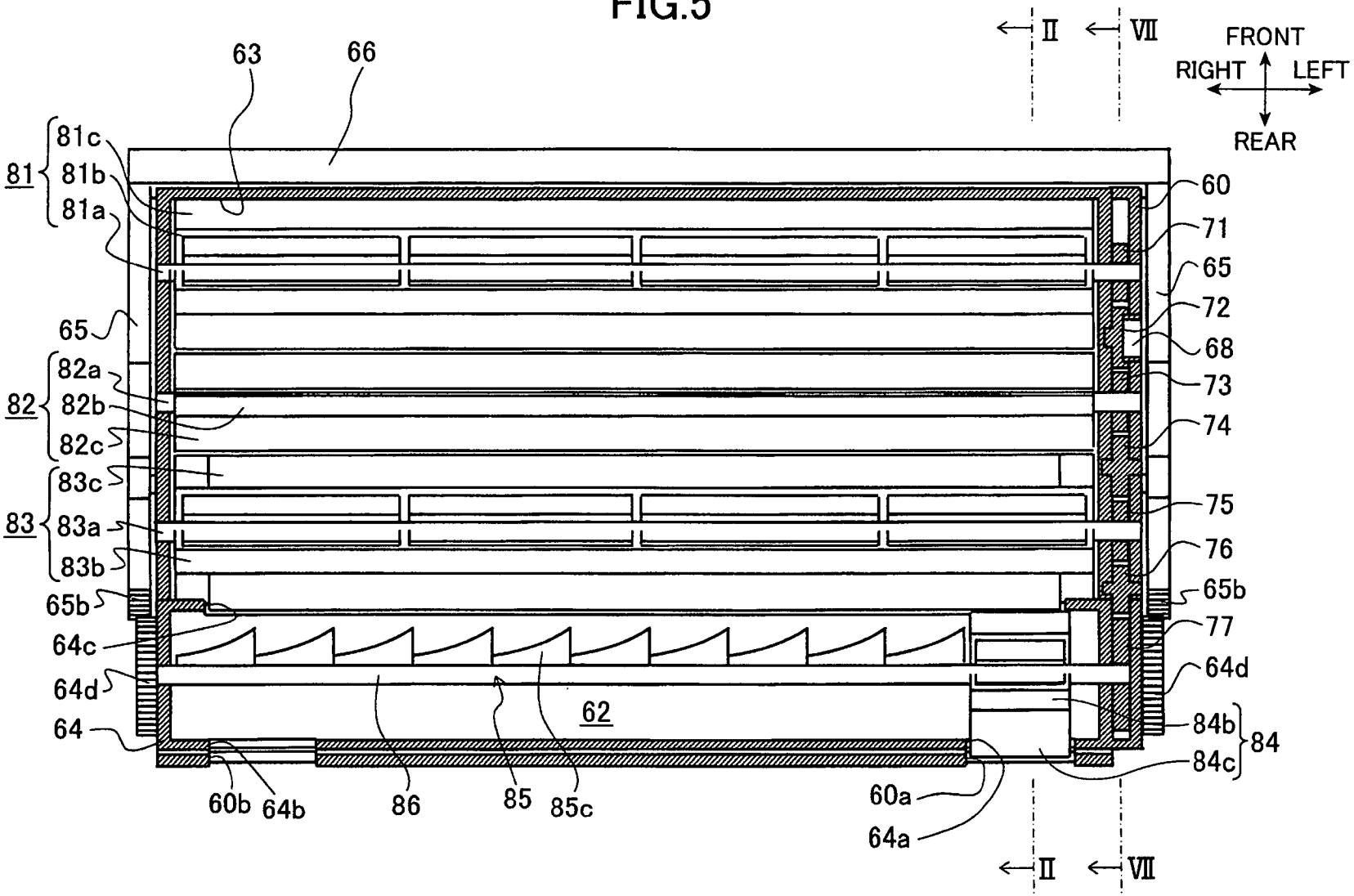
FIG. 5 is a horizontal cross sectional view showing the toner cartridge.

As shown in a left side view of FIG. 4 and a cross sectional view of FIG. 5, the cylinder 64 extends from one end of the toner cartridge 60 to the other end of the toner cartridge 60 in the axial direction of the developing roller 41. A gear 64*d* is provided at each end of the cylinder 64 and attached to a rotation axis of the cylinder 64.

Levers 65 are provided on left and right side surfaces of the accumulating chamber 63 to rotate around a shaft 65*a* provided on the left and right side surfaces of the accumulating chamber 63, respectively. A gear portion 65*b* is provided at one end of each lever 65 in order to engage with the gear 64*d*.

Figure 6:
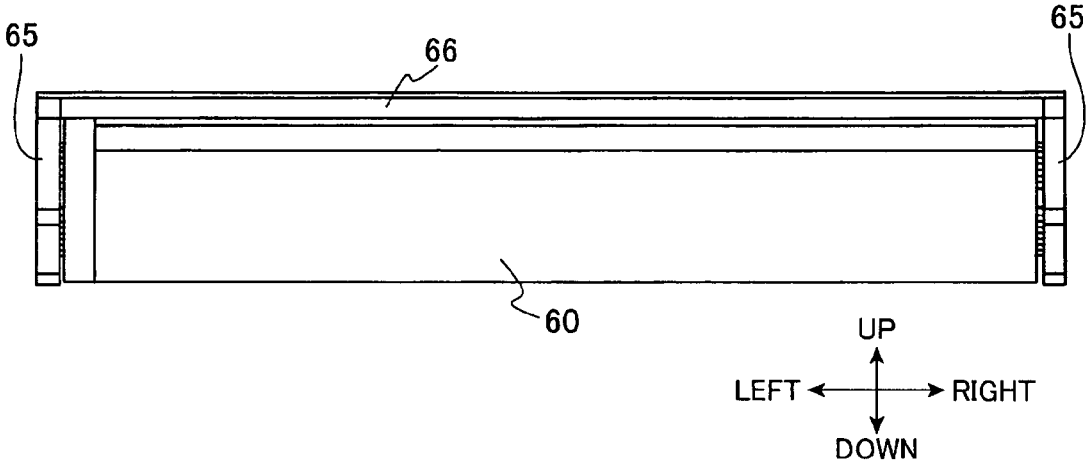
FIG. 6 is a front view showing the toner cartridge.

As shown in FIGS. 5 and 6, the other ends of the levers 65 are connected to each other through a bar 66 on a front side of the toner cartridge 60, so that the pair of levers 65 is pivotably movable in an integral manner. The pair of levers 65 and the bar 66 are integrally molded with resin.

With this structure, when the levers 65 is operated to rotate the gears 64*d*, the cylinder 64 is rotated between the communicating position shown in FIG. 4B and a closing position at which the openings 64*a*, 64*b* are not communicated with the feed port 60*a* and the return port 60*b* as shown in FIG. 4A. When the cylinder 64 is rotated to the closing position, the entire opening 64*c* is opposed to the cylindrical inner surface 62*a* of the circulating chamber 62, so that communication between the circulating chamber 62 and the accumulating chamber 63 is not established. Furthermore, protrusions 60*c* are provided on the left and right side surfaces 60E and 60F of the toner cartridge 60. When the levers 65 are rotated to the communicating position, the protrusions 60c come into contact with the levers 65, thereby prevent the levers 65 from further rotating.

Figure 3C:
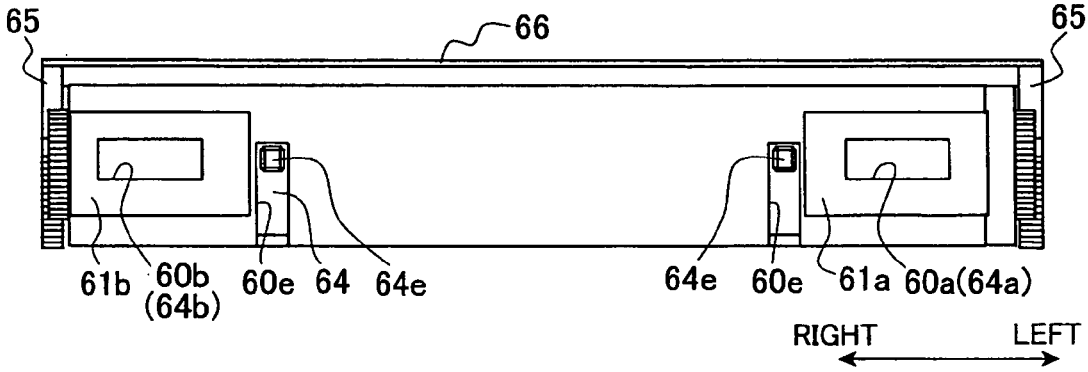
FIG. 3C is a rear view showing the toner cartridge, as viewed from the developing cartridge side.

As shown in FIG. 3C and FIG. 4A, 4B, bosses 64*e* are provided on the cylindrical surface of the cylinder 64. When the cylinder 64 is rotated, the bosses 64*e* face the supporting portion 42. As shown in FIG. 3C, each boss 64*e* protrude outward from the inside of the sponge members 61*a* and 61*b*. The toner cartridge 60 is provided with openings 60*e* for passing the bosses 64*a* therethrough at all rotation positions of the cylinder 64. As shown in FIG. 3B, a pair of boss holes 51*a*, 51*a* are formed in the shutter 51 for receiving the pair of bosses 64*e*, 64*e*, respectively. Grooves 42*c*, 42*c* are formed in the supporting portion 42 for guiding tip ends of the bosses 64*e*, 64*e*.

Thus, when the toner cartridge 60 is attached to the supporting portion 42 of the developing cartridge 40 with the cylinder 64 closing the feed port 60*a* and the return port 60*b*, the bosses 64*e* are engaged with boss holes 51*a*. When the levers 65 are operated to move the cylinder 64 to the communicating position, the shutter 51 is moved below the sponge members 53*a*, 53*b*. Accordingly, the sponge members 61*a*, 61*b* are brought into intimate contact with the sponge members 53*a*, 53*b*, respectively. Therefore, the openings 42*a*, 42*b* are communicated with the feed port 60*a* and the return port 60*b*, respectively.

Referring to FIG. 4B, driving bearings 68 are provided on each side surface 60E, 60F of the toner cartridge 60, respectively. The driving bearing 68 is accessible when the levers 65 are rotated to the position corresponding to the communicating position. The driving bearing 68 has a concave shape with which a driving shaft (not shown) provided in the laser printer 1 is engaged. In particular, the driving bearing 68 has protrusions 68*a* to be engaged with the driving shaft to receive a rotation force therefrom. The protrusions 68*a* provides a so-called driving coupling together with the driving shaft.

Figure 7:
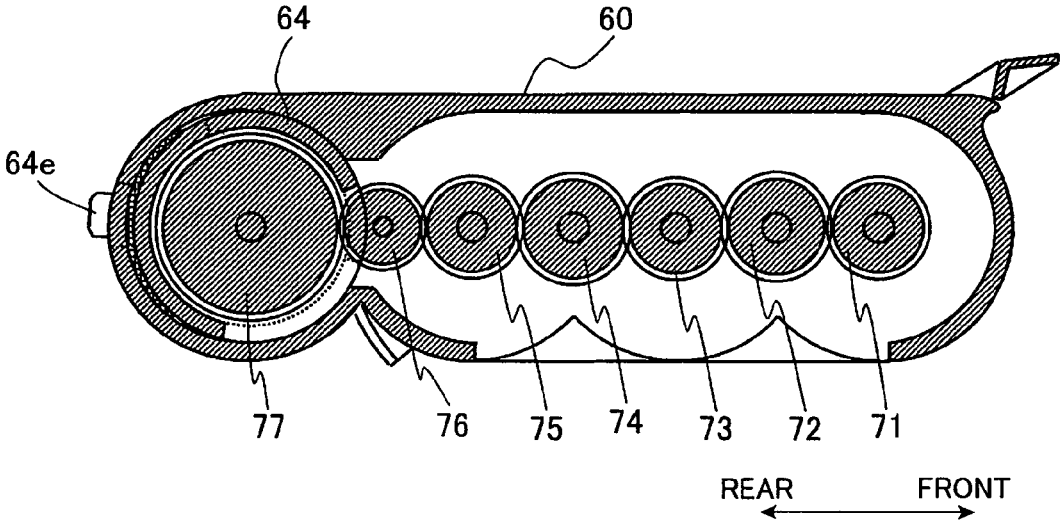
FIG. 7 is a vertical cross-sectional view showing the toner cartridge taken along VII-VII lines of FIG. 5.

A driving force transmitted to the driving bearing 68 is transmitted to agitators 81, 82, 83, 84, and 85 shown in FIG. 2B through gears 71, 72, 73, 74, 75, 76, and 77 aligned with each other as shown in FIG. 7. As shown in FIG. 2A, a driving bearing 55 having protrusions 55*a* are also provided at the left side surface of the developing cartridge 40. A driving force is transmitted to the driving bearing 55 from a driving shaft (not shown) provided in the laser printer 1. The driving force is then transmitted to the developing roller 41, the auger 43, and the supply roller 45 through gears 56, 57; 58, 59 as shown in FIG. 3A.

Referring to FIG. 2B, the agitators 81, 82, and 83 are provided in the accumulating chamber 63 to convey the toner in the direction to the circulating chamber 62, while agitating the toner in the accumulating chamber 63. The agitators 81, 82, and 83 are arranged in parallel in a direction to the circulating chamber 62 within the accumulating chamber 63. The agitator 81 has a rotation shaft Bla extending in the axial direction of the developing roller 41, a blade member 81*b* provided at the rotation shaft 81*a*, 82*a*, 83*a*, and an elastic film member 81*c* provided at a tip end of the blade member 81*b*. The agitators 82, 83 have rotation shafts 82*a*, 83*a* extending in the axial direction of the developing roller 41, blade members 82*b*, 83*b* provided at the rotation shafts 82*a*, 83*a*, and elastic film members 82*c*, 83*c* provided at a tip end of the blade members 82*b*, 83*b*, respectively. As shown in FIG. 5, the film member 83*c* has a width in the axial direction of the developing roller 41 which is the same as a horizontal width of the opening 64*c*. The lower surface of the accumulating chamber 63 is shaped like a triple barrel cylindrical surface, so that each of the rotating film members 81*c*, 82*c*, and 83*c* uniformly contacts the inner lower surface of the accumulating chamber 63.

The agitators 84, 85 has a common rotational shaft 86 which is concentric with the rotation axis of the cylinder 64. The agitator 84 has a blade member 84*b* provided at the rotational shaft 86 and an elastic film member 84*c* provided at a tip end of the blade member 84*b*; similarly to the agitators 81, 82, and 83. However, the agitator 84 is provided only at an area corresponding to a horizontal width of the feed port 60*a*. On the other hand, the agitator 85 is provided from the right end surface of the cylinder 64 to the position adjacent to the agitator 84. The film member 85*c* of the agitator 85 has incisions at some positions in the direction perpendicular to the rotational shaft 86. The cut ends are twisted in the direction toward the feed port 60*a*. The rotating agitator 83 conveys the toner from the return port 60*b* to the feed port 60*a*, while agitating the toner in the cylinder 64.

Figure 8A:
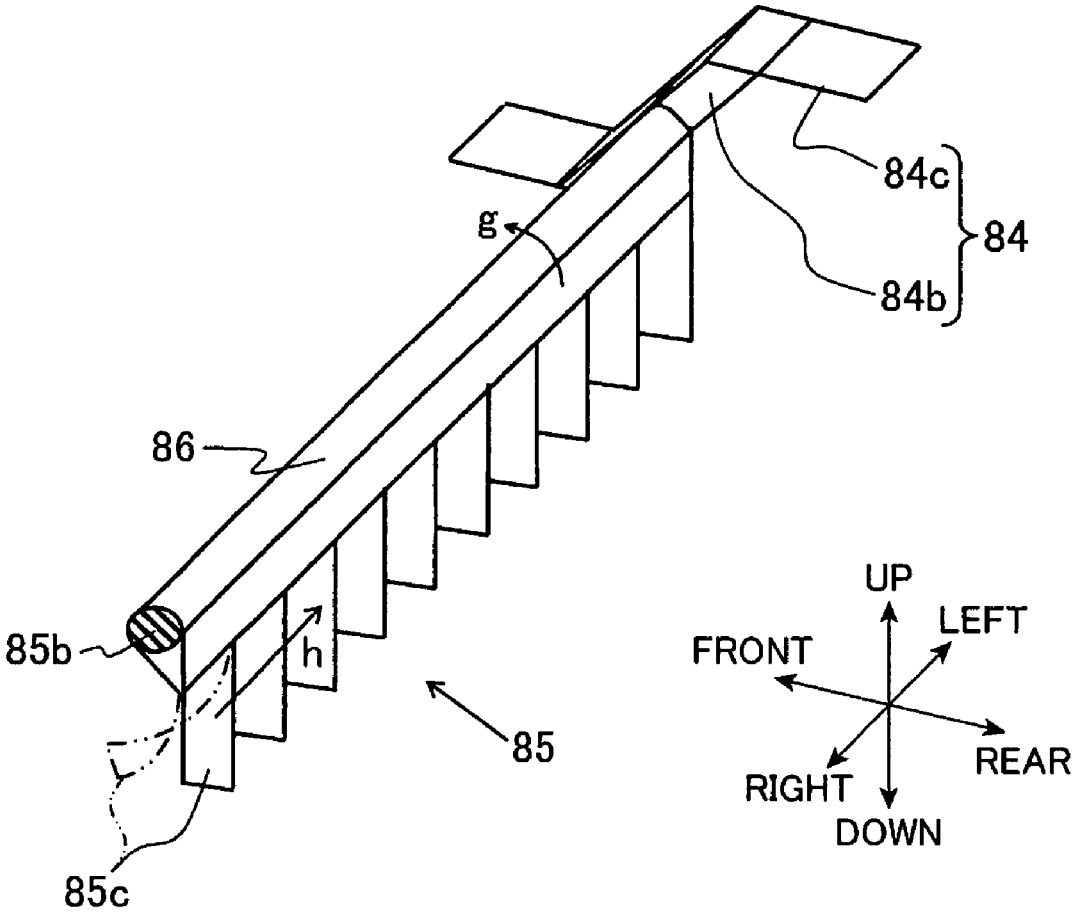
FIG. 8A is a perspective view showing an agitator in a circulating chamber of the toner cartridge.
Figure 8B:
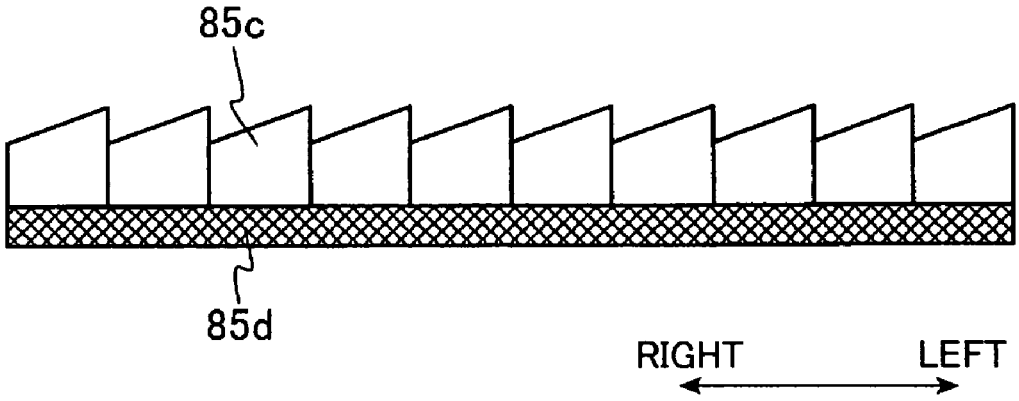
FIG. 8B is a plan view showing a film member of the agitator.

Here, configuration of the agitator 85 will be described in more detail with reference to FIGS. 8A and 8B. As shown in FIG. 8A, the film member 85c is attached to a substantially triangle cross-section supporting member 85*b* molded integrally with the rotational shaft 86. As shown in FIG. 8B, a two-sided tape 85*d* is adhered to the supporting member 85*b*. The two-sided tape 85*d* has a plurality of notches reaching the supporting member 85*b*. A tip end of each of the notched parts is cut at a slanting angle with respect to the return port 60*b*. The film member 85*c* has a greater length from the rotational shaft 86 than a radius of the cylinder 64 on the side of the return port 60*b*.

When the agitator 85 is mounted in the cylinder 64 and the rotational shaft 86 is rotated in a direction shown by an arrow "g" in FIG. 8A, the film member 85*c* is twisted as shown by a two-dot chain. When the rotational shaft 86 further rotates in the direction of the arrow "g", the toner is conveyed in the cylinder 64 in a direction shown by an arrow "h".

With the above structure of the laser printer 1, the toner fed from the toner cartridge 60 to the developing cartridge 40 through the feed port 60*a* is conveyed to the return port 60*b*, while moving in the developing cartridge 40 by the auger 43. Furthermore, the toner which has returned from the developing cartridge 40 to the toner cartridge 60 through the return port 60*b* is conveyed to the vicinity of the feed port 60*a* again while being agitated by the agitator 85.

Thus, in this embodiment, the toner can be satisfactorily circulated between the developing cartridge 40 and the toner cartridge 60. Moreover, since the toner cartridge 60 is divided into the circulating chamber 62 and the accumulating chamber 63 and the toner is circulated between the circulating chamber 62 and the developing cartridge 40, circulation is performed more smoothly. Since only one auger 43 is provided and the toner cartridge 60 has a flat shape, the developing cartridge 40 and the toner cartridge 60 can be made flat, and the height of the laser printer 1 can be reduced.

Further, in this embodiment, since the three agitators 81, 82, 83 convey the toner in the toner cartridge 60 to the cylinder 64, the toner can be fed effectively. Moreover, when the toner cartridge 60 is horizontally disposed with the lower surface 60B being positioned at the bottom, the toner is circulated between the toner cartridge 60 and the developing cartridge 40 without being affected by gravity. Furthermore, in this embodiment, since the toner fed through the auger 43 is fed to the developing roller 41 via the supply roller 45, a toner layer formed on the surface of the developing roller 41 has more uniform thickness, thereby achieving more uniform development.

In this embodiment, when the cylinder 64 is rotated to the communicating position, the shutter 51 is moved to open the feed port 60*a* and the return port 60*b*, and the circulating chamber 62 is communicated with the accumulating chamber 63. In this state, the toner is fed from the toner cartridge 60 to the developing cartridge 40 and circulated between the toner cartridge 60 and the developing cartridge 40, when the agitators 81, 82, 83, 84, and 85 and the auger 43 are driven to rotate.

When the cylinder 64 is rotated to the closing position, the shutter 51 is moved to close the feed port 60*a* and the return port 60*b* and the communication between the circulating chamber 62 and the accumulating chamber 63 is interrupted. In this state, the toner cartridge 60 is removed from the developing cartridge 40 and easily exchanged with a new toner cartridge. Since the cylinder 64 can be rotated by operating the levers 65 on the front side of the laser printer 1 for an exchange of the toner cartridge 60, operability in exchanging the toner cartridge 60 is improved.

Figure 9:
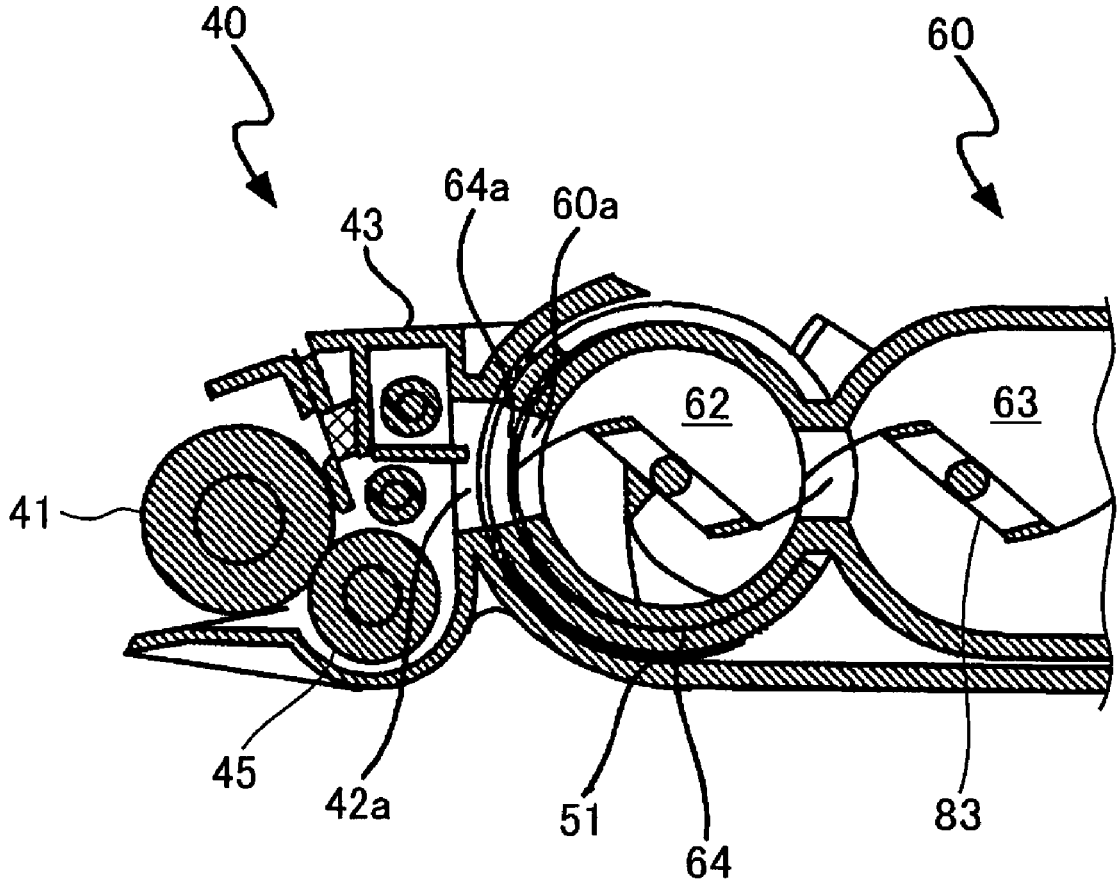
FIG. 9 is a vertical cross-sectional view showing another structure of the toner cartridge.

As shown in FIG. 9, the cylinder 64 may be rotatably provided on an outer surface of the circulating chamber 62 of the toner cartridge 60. In another embodiment, a gear mechanism may be provided in order to transmit a driving force between the developing cartridge 40 and the toner cartridge 60. In this case, a driving force supplied from the laser printer 1 can be merely transmitted to either one of the developing cartridge 40 and the toner cartridge 60.

As described above, the toner fed from the toner cartridge to the developing cartridge through the feed port is conveyed to the return port by the auger while transferring in the developing cartridge. The toner returned to the toner cartridge through the return port is conveyed to the vicinity of the feed port again, while being agitated by the agitators.

With the agitators 84, 85 and the auger 43, the toner is efficiently circulated between the developing cartridge 40 and the toner cartridge 60. Since the auger 43 is single and the toner cartridge 40 has a low height, the developing unit constituted by the developing cartridge 40 and the toner cartridge 60 has a lower height. Accordingly, the laser printer 1 can be reduced in size. Furthermore, since the agitators 81, 82, and 83 convey the toner in the toner cartridge 60 to the vicinity of the agitator 84 and 85, the toner is efficiently fed to the toner cartridge 60. Moreover, when the toner cartridge 60 is horizontally disposed, the toner circulates between the toner cartridge 60 and the developing cartridge 40 without being affected by gravity, thereby preventing the toner from accumulating at one point for a long time.

In this case, since the toner fed via the auger is fed to the developing roller with the supply roller, a toner layer having a uniform thickness is formed on the surface of the developing roller, thereby contributing to improved development of the electrostatic latent image.

Since the front end of the film 85*c* is twisted toward the feed port 60*a*, the toner is efficiently conveyed from the return port 60*b* to the feed port 60*a* when the film 85*c* rotates around the shaft 85*b*. The above structure of the agitator 85 enables reduction in manufacturing costs of the laser printer 1.

By rotating the cylinder 64 inside the circulating chamber 62, opening/closing of the feed port 60*a* and the return port 60*b* and communication between the circulating chamber 62 and the accumulating chamber 63 are performed simultaneously. Accordingly, leakage of the toner from the toner cartridge 60 is readily prevented. Further, by merely rotating the cylinder 64 to the communicating position within the circulating chamber 62 after attaching the toner cartridge 60 to the developing cartridge 40, the developing cartridge 40 and the toner cartridge 60 are ready for the operation of the laser printer 1. Therefore, the operation for attaching the toner cartridge 60 to the toner cartridge 60 becomes easy.

By merely moving the pair of lever 65 from the front side of the laser printer 1, the cylinder 64 is rotated in the circulating chamber 62. Accordingly, the opening/closing of the feed port 60*a* and the return port 60*b* and communication between the circulating chamber 62 and the accumulating chamber 63 can be performed more easily.

By moving the pair of levers 65, the shutter 51 for the openings 42*a*, 42*b* of the developing cartridge 40 is simultaneously moved through the engagement of the boss 64*e*, 64*e* and the boss hole 51*a*, 51*b*. When the cylinder 64 is rotated to the communicating position, the feed port 60*a* and the return port 60*b* are opened, and communication between the circulating chamber 62 and the accumulating chamber is established.

On the other hand, when the cylinder 64 is rotated to the closing position, the feed port 60*a* and the return port 60*b* are closed, and communication between the circulating chamber 62 and the accumulating chamber is interrupted.

While the invention has been described in detail with reference to the above aspects thereof, it would be apparent to those skilled in the art that various changes and modifications may be made therein without departing from the spirit of the invention.

What is claimed is:

1. A toner cartridge containing toner to develop an electrostatic latent image, the toner cartridge being attachable to a developing cartridge, comprising:

a substantially rectangular mounting surface detachably attached to the developing cartridge, facing the developing cartridge, the mounting surface having two ends in a longitudinal direction;

an agitation mechanism that agitates the toner;

a conveyance mechanism that conveys the toner to the agitation mechanism;

an feed port provided in one end of the mounting surface, the feed port being communicable with the developing cartridge; and an return port provided in the other end of the mounting surface, the return port being communicable with the developing cartridge, wherein the toner cartridge has a cross section perpendicular to the longitudinal direction, the cross section having a first length in a first direction directed to the mounting surface, and a second length in a direction perpendicular to the first direction and perpendicular to the longitudinal direction, the first length being greater than the second length, wherein the toner cartridge is divided into a circulating chamber in which the toner is agitated by the agitation mechanism and circulated through the developing cartridge, and an accumulating chamber in which the toner is conveyed to the circulating chamber by the conveyance mechanism, wherein the circulating chamber comprises a first cylindrical member and a second cylindrical member fitted around the first cylindrical member, one of the first and second cylindrical members being rotatable with respect to the other of first and second cylindrical members to open and close the feed and return ports, wherein a first positional relationship between the first and second cylindrical members causes the feed port and the return port to be closed, thereby interrupting a communication between the circulating chamber and the accumulating chamber, wherein a second positional relationship between the first and second cylindrical members causes the feed port and the return port to be opened, thereby establishing the communication, wherein the first cylindrical member comprises an engaging portion engageable with a shutter of the developing cartridge, the engaging portion being capable of moving the shutter to a first position at which the toner cartridge is not communicated with the developing cartridge, the engaging portion being capable of moving the shutter to a second position at which the toner cartridge is communicated with the developing cartridge, and wherein the engaging portion is positioned between the feed port and the return port.

* * * * *